US005570327A

United States Patent [19]

Chen

[11] Patent Number: 5,570,327

[45] Date of Patent: Oct. 29, 1996

[54] TING ACTUATING DEVICE FOR CLOCK MECHANISM

[76] Inventor: Ching-Ti Chen, Suite 1, 11F. No. 95-8 Chang-Ping Road, Sec. 1, Taichung, Taiwan

[21] Appl. No.: 379,191

[22] Filed: Jan. 24, 1995

[51] Int. Cl.[6] ..... G04G 13/02

[52] U.S. Cl. ..... 368/272

[58] Field of Search ..... 368/272, 270, 368/271, 273, 274

[56] References Cited

U.S. PATENT DOCUMENTS

| | | | |
|---|---|---|---|
| 433,220 | 7/1890 | Sprangers | 368/272 |
| 5,239,523 | 8/1993 | Chin-Hsing | 368/63 |

FOREIGN PATENT DOCUMENTS

| | | | |
|---|---|---|---|
| 502747 | 9/1992 | European Pat. Off. | 368/272 |

*Primary Examiner*—Bernard Roskoski

[57] ABSTRACT

A ting actuating device for clock mechanism comprises generally a housing, a clock mechanism driven by a battery chamber and a circuit plate. A protrudent member is formed on the top surface of a minute wheel thereof in cooperation with a pair of a first and second conductor rods parallel disposed on a positioning plate inside the housing and toward the center of the minute wheel. The improvement has been characterized in that the conductor rods connect at one end to a power source and a load of musical sounding device where the first conductor rod is longer than that of the second conductor rod and extending exceeded the circularly travelling track of the protrudent member which pushes the first conductor rod upon each turn of the minute wheel, contacting the second conductor rod to switch on the load of musical sounding device to run hourly.

4 Claims, 5 Drawing Sheets

TING ACTUATING DEVICE FOR CLOCK MECHANISM

BACKGROUND OF THE INVENTION

The present invention relates to clock mechanism, more particularly to a clock mechanism having a ting actuating device which can mechanically actuate different kind of musical sounding device for amusing the user.

Prior art electronic clock usually has an electronically synthetic hourly tining device composed of an electrical circuit having progressive counter therein. The electrical circuit is connected at two ends to an actuating device of the clock mechanism. So that the hourly tining device will be actuated to timely release the ting to show certain hours. However, when the hourly tining device is adapted to the prior art electronic clock, the clock cannot vary the musical sound and thus is monotonous.

SUMMARY OF THE PRESENT INVENTION

The main object of the present invention is to provide a ting actuating device for clock mechanism which can mechanically actuate different kind of musical sounding device to hourly release pleasant melody.

Another object of the present invention is to provide a ting actuating device for clock mechanism having simplified structure which is adjustable for releasing different length of sound to show the hours.

To attain the above mentioned objects, the ting actuating device for clock mechanism of the present invention comprises generally a housing, a power source, a circuit plate and a plurality of different wheels rotatably disposed on a positioning plate therein. The improvement has been characterized in that a protrudent member projects on the upper surface of the minute wheel, in cooperation with a pair of conductor rods which have different lengths disposed spacedly and parallel along the radial direction of the minute wheel with the longer conductor rod extending excessed the circularly travelling track of the protrudent member. So that when the protrudent member movably passes through the longer conductor rod will push the longer conductor rod bowed away and contacting with the shorter conductor rod transiently so as to electrically actuate a musical sounding device for releasing hourly pleasant melody. Since the position of the protrudent member and the length of the longer conductor rod are displaceable and adjustable. So that the contact time of the pair of conductor rods is variable.

The present invention will become fully understood by reference to the following detailed description thereof when read in accompanying with the attached drawings.

DETAILED DESCRIPTION OF THE PREFERRED EMBODIMENT OF THE PRESENT INVENTION

Figure 1:
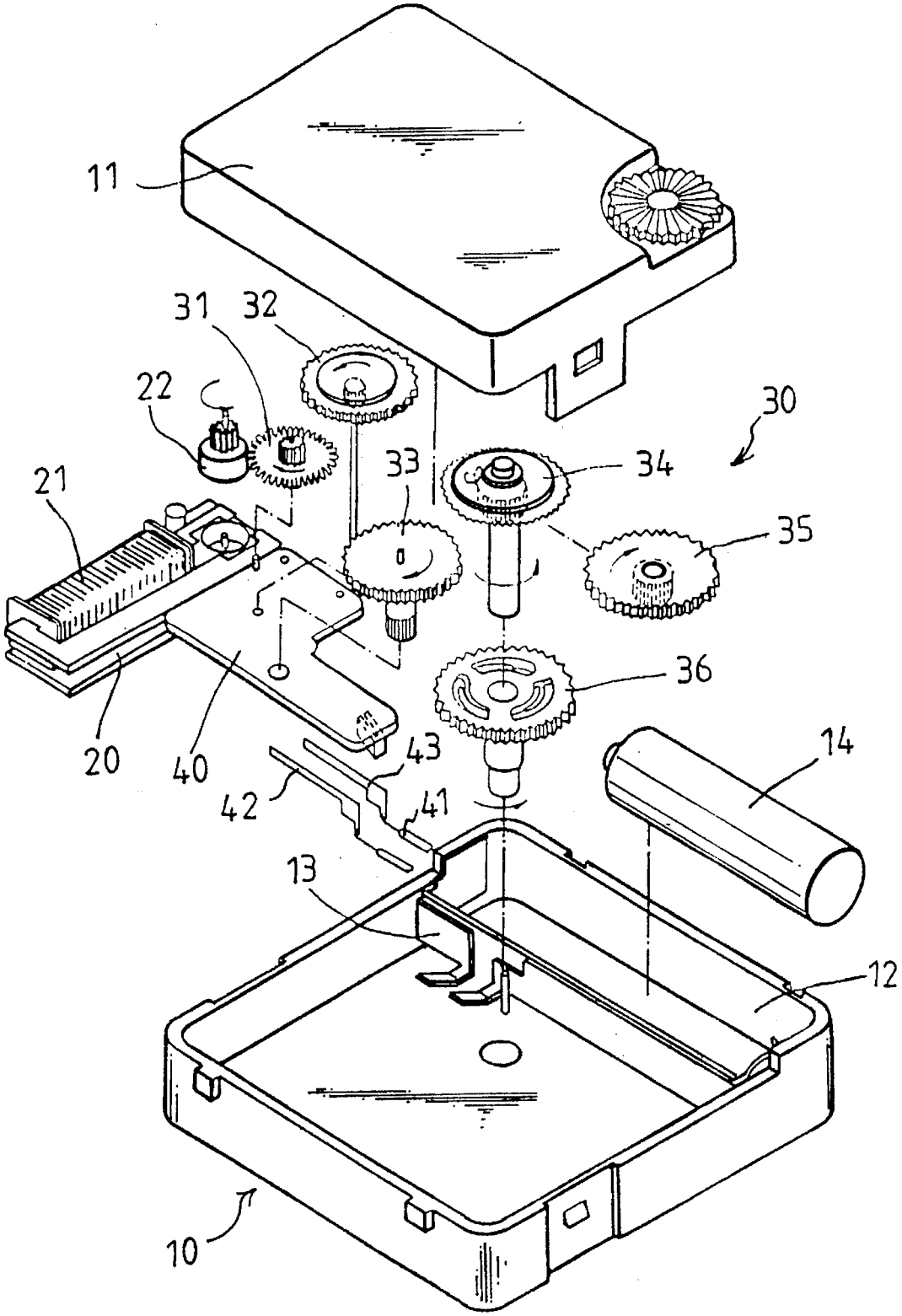
FIG. 1 is an exploded perspective view to show a preferred embodiment of the present invention, FIG, 2 is a perspective view to illustrate the interrelation of the minute wheel and the conductor rods according to the present invention.

Referring to FIG. 1 of the drawings, the ting actuating device for clock mechanism of the present invention comprises a housing 10 having a lid member 11, a battery chamber 12 for disposing a battery 14 therein, a contact means 13, a circuit plate 20 including an electric coil 21 fixed thereon and an active wheel 22 rotatably fixed thereon and a number of wheels 30 including a first wheel 31, a second wheel 32, a third wheel 33, a minute wheel 34, a fourth wheel 35 and an hour wheel 36 sequentially meshed one another and rotatably disposed to a positioning plate 40 thereon.

Upon the communication of power source, the electric coil 21 intermittently actuates the active wheel 22 to rotate for driving the first wheel 31 to move and in turn effecting the second wheel 32, the third wheel 33, the minute wheel 34, the fourth wheel 35 and the hour wheel 36 to rotate precisely showing the exact times.

Figure 2:
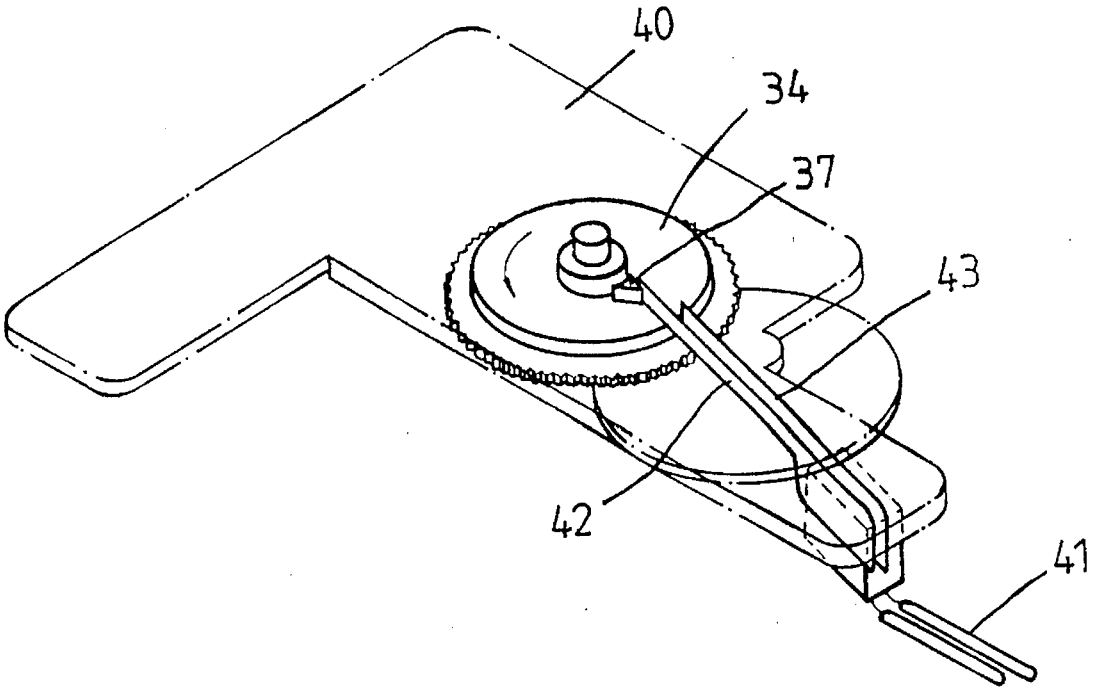

Referring to FIG. 2, which shows a roughly right triangular protrudent member 37 projected on the top surface of the minute wheel 34 and positioned at a radial line thereof and a pair of a first conductor rod 42 and a second conductor rod 43 parallel disposed to a predetermined position of the positioning plate 40 and directing to the radial orientation of the minute wheel 34. The rear ends of the conductor rods 42 and 43 connect to a pair of cords 41 which connect to the power source and a load member respectively. The first conductor rod 42 is longer than that of the second conductor rod 43 and extended radially toward the center of the minute wheel 34 with the free end thereof exceeding the circularly travelling track of the protrudent member 37. So that they can meet each other once after 60 minutes.

Figure 6:
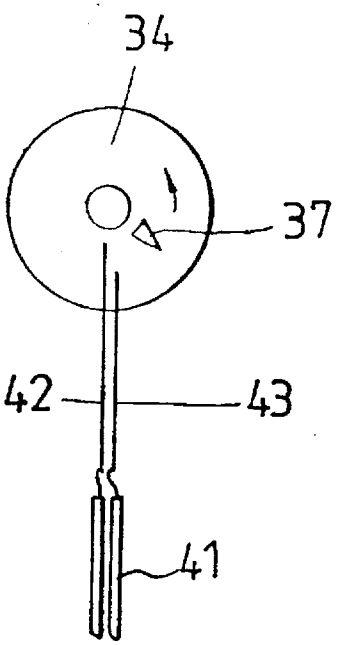
FIGS. 3 to 6 are the diagrams schematically illustrating the operation states of the minute wheel and the conductor rods.
Figure 5:
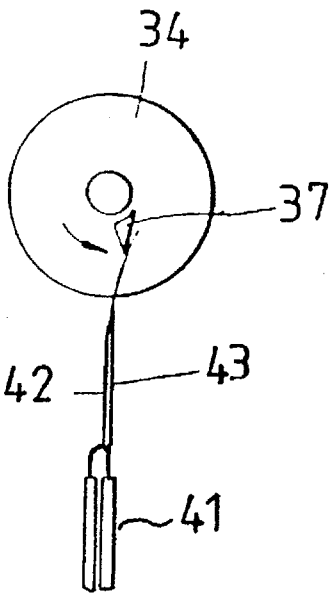
Figure 4:
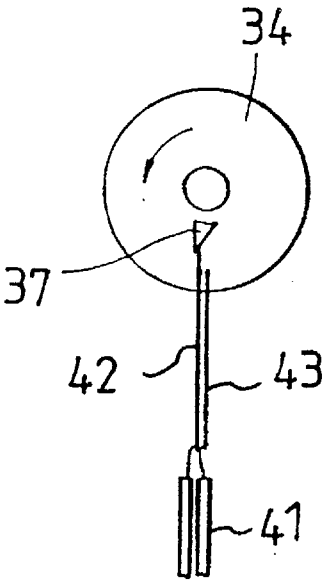
Figure 3:
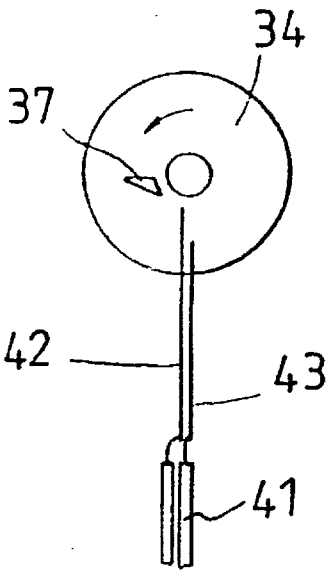

Referring to FIGS. 3 to 6 of the drawings, which schematically illustrate the process of the touch and departing of the protrudent member 37 with the first conductor rod 42. FIG. 3 shows the protrudent member 37 on the revolving minute wheel 34 at a position before the touch of the first conductor rod 42. FIGS. 4 and 5 show that they begin to touch each other and the first conductor rod has been bowed away and contacts the second conductor rod 43 for a certain period of time before the departing of the pretrudent member 37 from the first conductor rod 42 as shown in FIG. 6.

Figure 7:
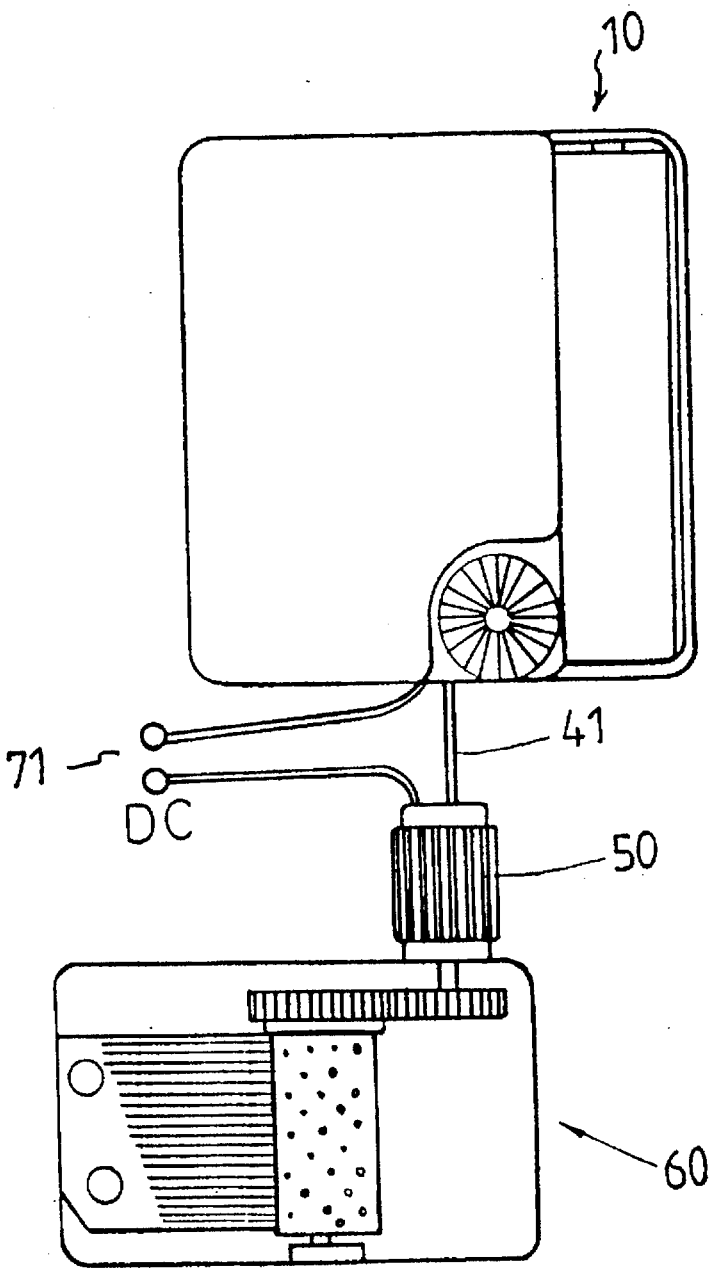
FIG. 7 is a top view to show the structural relationship between the clock mechanism and the musical sounding device.
Figure 8:
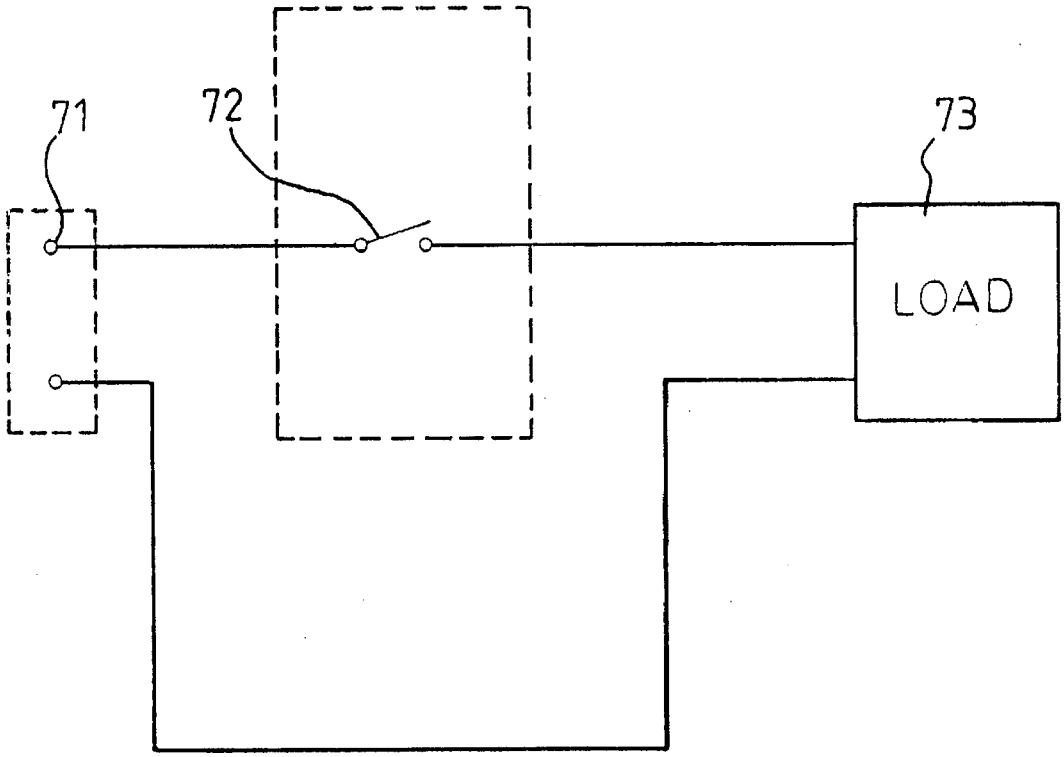
FIG. 8 is a diagram of FIG. 7.

Referring to FIG. 8 which is a diagram to indicate that the conductor rods 42 and 43 become a switch 72. When they contact, the switch 72 turns on to communicate the power source 71 with the load 73. FIG. 7 shows a musical sounding device 60 connected to the conductor rods 42 and 43 and the power source via a motor 50 and the cord 41. So that the musical sounding device 60 being effected by the motor 50 begins to run when the conductor rods have contacted. Since that the sounding device of the present invention can be varied to provide different sound or melody cheering the users.

Further, the position of the right triangular protrudent member 37 is displaceable on the surface of the minute wheel 34 along the radial orientation thereof as well as the length of the first conductor rod 42 that can be adjustable, so that the contact period of time between the first and second conductor rods 42 and 43 is variable in concomitance with different sorts of the sounding device requiring different length of time.

Many modifications and variations could also be accomplished by a person of average skill in the art and as such the scope of the present invention should not be inferred from the specification of the above embodiment but should instead be determined from the appended claims.

I claim:

1. A ting actuating device for clock mechanism comprising:

a housing for disposing said clock mechanism therein having a battery chamber, a circuit plate and a number of different wheels sequentially meshed one another and rotatably disposed on a positioning plate therein, said different wheels being intermittently driven by said circuit plate via a active wheel thereon;

a right triangular protrudent member formed on the top surface of a minute wheel along a radial orientation thereof in cooperation with a pair of a first and a second conductor rods disposed to a predetermined position of said positioning plate and parallel extended toward the center of said minute wheel, said conductor rods being connected at one end with a power source and a load via a pair of cords respectively, with said first conductor rods being longer than that of said second conductor rod and exceeding the circularly travelling track of said protrudent member on said minute wheel;

Whereby said first conductor rod is contacted by said protrudent member upon each turn of said minute wheel and is bowed away to contact said second conductor rod for switching on a load of musical sounding device attached thereon.

2. A ting actuating device according to claim 1, wherein said first conductor rod is lengthily adjustable.

3. A ting actuating device according to claim 1, wherein said sounding device is variable.

4. A ting actuating device according to claim 1, wherein said protrudent member is displaceable along a radial line on said minute wheel.

* * * * *